US005938350A

United States Patent [19]

Colonel

[11] Patent Number: 5,938,350

[45] Date of Patent: Aug. 17, 1999

[54] THERMAL INK PRINTER WITH INK RIBBON SUPPLY

[75] Inventor: Kenneth Colonel, Oviedo, Fla.

[73] Assignee: Datamax Corporation, Orlando, Fla.

[21] Appl. No.: 08/878,654

[22] Filed: Jun. 19, 1997

[51] Int. Cl.[6] ..... B41J 33/14

[52] U.S. Cl. ..... 400/234; 400/208; 400/613

[58] Field of Search ..... 400/120.01, 208, 400/222, 223, 225, 231, 232, 234, 236, 613; 101/288; 347/215; 346/105

[56] References Cited

U.S. PATENT DOCUMENTS

| | | | |
|---|---|---|---|
| 4,547,780 | 10/1985 | Cummins | 346/9 |
| 4,642,656 | 2/1987 | Shibuya et al. | 347/215 |
| 4,797,690 | 1/1989 | Takita et al. | 346/105 |
| 5,143,461 | 9/1992 | Inoue et al. | 400/225 |
| 5,284,396 | 2/1994 | Masumura et al. | 400/234 |
| 5,318,368 | 6/1994 | Fogle et al. | 400/208 |
| 5,326,182 | 7/1994 | Hagstrom | 400/223 |
| 5,340,098 | 8/1994 | Gunderson | 271/21 |
| 5,370,470 | 12/1994 | Kim | 400/234 |
| 5,378,072 | 1/1995 | Gunderson | 400/692 |
| 5,399,036 | 3/1995 | Yamaguchi | 400/236 |
| 5,478,159 | 12/1995 | Schneider et al. | 400/232 |
| 5,480,242 | 1/1996 | Gunderson | 400/208 |
| 5,496,121 | 3/1996 | Gunderson | 400/692 |
| 5,622,440 | 4/1997 | Yamamoto et al. | 400/234 |

FOREIGN PATENT DOCUMENTS

| | | | |
|---|---|---|---|
| 59-156786 | 9/1984 | Japan | 400/234 |
| 61-197267 | 9/1986 | Japan | 400/234 |
| 4-292972 | 10/1992 | Japan | 400/234 |

*Primary Examiner*—Christopher A. Bennett
*Attorney, Agent, or Firm*—Dilworth & Barrese

[57] ABSTRACT

An ink supply spool for a thermal ink printer includes a central shaft defining a longitudinal axis, a ribbon hub coaxially mounted about the central shaft for rotational movement thereabout and adapted to support a supply of ink transfer ribbon in a coiled configuration, a torsion spring mounted about the central shaft and operatively engageable with the ribbon hub to rotatably bias the ribbon hub to an initial position corresponding to an unstressed condition of the torsion spring in response to movement of the ribbon hub through a predetermined angular sector of rotation in one rotational direction, to thereby maintain a predetermined level of tension on the ink transfer ribbon, a clutch mechanism associated with the ribbon hub to permit the torsion spring to return to the unstressed condition in response to movement of the ribbon hub beyond the predetermined angular sector of rotation, and a support collar mounted about the central shaft adjacent the torsion spring for supporting the torsion spring during movement of the ribbon hub in the one rotational direction.

26 Claims, 4 Drawing Sheets

THERMAL INK PRINTER WITH INK RIBBON SUPPLY

BACKGROUND OF THE INVENTION

1. Field of the Invention

The present invention relates generally to thermal printers and, more particularly, to a ribbon supply for use in thermal transfer printers.

2. Description of the Prior Art

The use of electronically controlled thermal printers has increased very rapidly over the last few years. In particular, the market for thermal label printers has shown significant improvement with users focusing on utilizing label printing, especially, bar-code labelling, to improve capital asset management, inventory control or time and attendance reporting—or to meet corporate or industry mandated labelling requirements—such as automotive AIAG, electronic EIA or retail UCC/UPC specifications. Label printers typically incorporate a media hub or supply of "peel away" labels adhered to a coated substrate wound in a rolled configuration. The media with the labels is drawn against a printing head, which, in turn, causes, by localized heating, a transfer of ink from an ink ribbon to a label.

The ink ribbon of these label printers may be supplied from an ink ribbon roll having a ribbon core about which the ink ribbon is wound. The ribbon core is formed of plastic or relatively thick cardboard and is mounted to a ribbon supply feed. The ink ribbon is drawn off the ribbon core to be sent through the printing head by a drive motor which is associated with a "take-up" roll mechanism. Preferably, a drag clutch is associated with the ribbon supply feed to prevent the ribbon core from rotating in a non-feed direction and to maintain a predetermined amount of drag on the ink ribbon during the printing process.

Several disadvantages of conventional ribbon supply feeds for these thermal label printers are apparent. For example, the drag clutch arrangements incorporated within the supply feeds are relative complex requiring a large number of moving and interengaging component parts. In addition, conventional clutch arrangements typically incorporate spring mechanisms which are subject to degradation (e.g. deformation of the torsion spring, etc. . . . ) over extended periods of use. Consequently, the level of drag applied to the ink ribbon may decrease to a level outside acceptable limits, which often undesirably affects the quality of the printed media. Furthermore, as the clutch surfaces wear, the frictional torque increases thereby changing the degree of angular rotation(s) of the supply feed.

SUMMARY OF THE INVENTION

Accordingly, the present invention is directed to an ink ribbon supply feed which obviates the disadvantages of the prior art by providing structure to maintain and preserve the integrity of the torsion spring mechanism(s) therein. In one preferred embodiment, an ink supply spool for a thermal ink printer includes a central shaft defining a longitudinal axis, a ribbon hub coaxially mounted about the central shaft for rotational movement thereabout and adapted to support a supply of ink transfer ribbon in a coiled configuration, a torsion spring mounted about the central shaft and operatively engageable with the ribbon hub to rotatably bias the ribbon hub to an initial position corresponding to an unstressed condition of the torsion spring in response to movement of the ribbon hub through a predetermined angular sector of rotation in one rotational direction thereby maintaining a predetermined level of tension on the ink transfer ribbon, clutch means associated with the ribbon hub to permit the torsion spring to return to the unstressed condition in response to movement of the ribbon hub beyond the predetermined angular sector of rotation, and a support collar mounted about the central shaft adjacent the torsion spring for supporting the torsion spring during movement of the ribbon hub in the one rotational direction. A spring housing may be mounted to the central shaft and dimensioned to at least partially enclose the torsion spring.

In a preferred embodiment, the support collar and the torsion spring are coaxially mounted about the central shaft, with the support collar being at least partially disposed within the torsion spring. The support collar is preferably dimensioned to be engaged by the torsion spring in supporting contacting relation therewith upon movement of the ribbon hub through the predetermined angular sector of rotation. In this manner, the support collar prevents over tensioning of the torsion spring and consequent deformation thereof.

The preferred clutch means includes an outer hub mounted about the central shaft adjacent the ribbon hub. The outer hub is in operative engagement with the torsion spring and in frictional engagement with the ribbon hub along respective adjacent surfaces of the ribbon hub and the outer hub. The outer hub is movable with the ribbon hub in the one direction whereby movement of the ribbon hub beyond the predetermined angular sector of rotation causes release of the adjacent surfaces of the outer hub and the ribbon hub, due to torsional forces of the torsion spring, to permit the torsion spring to return to an unstressed condition thereof. The clutch means may include a compression spring operatively engageable with the outer hub and dimensioned to bias the outer hub toward the ribbon hub.

The ribbon hub may also be adapted to rotate in a second rotational direction opposite the first rotational direction to feed the ink transfer ribbon. With this arrangement, the torsion spring rotatably biases the ribbon hub to the initial position upon movement of the ribbon hub through a second predetermined angular sector of rotation in the second rotational direction thereby maintaining a predetermined level of tension on the ink transfer ribbon. The torsion spring is engaged by an inner surface of the spring housing in supporting contacting relation therewith during movement in the second rotational direction, which thereby prevents deformation of the torsion spring in this direction.

In another preferred embodiment, the ink supply spool for a thermal ink printer includes a central shaft defining a longitudinal axis and a ribbon hub coaxially mounted about the central shaft and adapted for rotational movement in first and second rotational directions. The ribbon hub is adapted to support a supply of ink transfer ribbon in a coiled configuration and includes an inner member and an outer member. The inner member and the outer member are in frictional contacting engagement along adjacent surfaces thereof such that the inner member and the outer member concurrently rotate in the first and second rotational directions. A coil spring is mounted about the central shaft and is operatively connected to the outer member and to the central shaft to rotatably bias the ribbon hub to an initial unstressed condition thereof in response to movement of the ribbon hub through respective first and second predetermined angular sectors of rotation in the first and second rotational directions, to thereby maintain a predetermined level of tension of the ink transfer ribbon. The coil spring is dimensioned and configured to cause release of the adjacent surfaces of the inner and outer members from their frictional contacting engagement in response to movement of the ribbon hub beyond either the first and second predetermined angular sectors of rotation, to thereby permit the coil spring to return to an initial unstressed condition.

A support collar is coaxially mounted within the coil spring. The support collar is dimensioned to be engaged by the coil spring during rotation of the ribbon hub in at least the first rotational direction, preferably, both rotational directions, to support the coil spring to minimize deformation thereof. A spring housing is coaxially mounted about the coil spring and is dimensioned to be engaged by the coil spring during rotation of the ribbon hub in the second rotational direction to support the coil spring to minimize deformation thereof.

In another preferred embodiment, the ink supply spool for a thermal ink printer includes a central shaft defining a longitudinal axis, a ribbon hub coaxially mounted about the central shaft and adapted for rotational movement thereabout, and adapted to support a supply of ink transfer ribbon in a coiled configuration, a torsion spring mounted about the central shaft and operatively engageable with the ribbon hub to rotatably bias the ribbon hub to an initial position corresponding to an unstressed condition of the torsion spring to thereby maintain a predetermined level of tension on the ink transfer ribbon, first clutch means associated with the ribbon hub to permit the torsion spring to return to the unstressed condition in response to movement of the ribbon hub beyond a first predetermined angular sector of rotation in one rotational direction, second clutch means associated with the ribbon hub to permit the torsion spring to return to the unstressed condition in response to movement of the ribbon hub beyond a second predetermined angular sector of rotation in the one rotational direction and a support collar mounted about the central shaft adjacent the torsion spring for supporting the torsion spring during movement of the ribbon hub.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
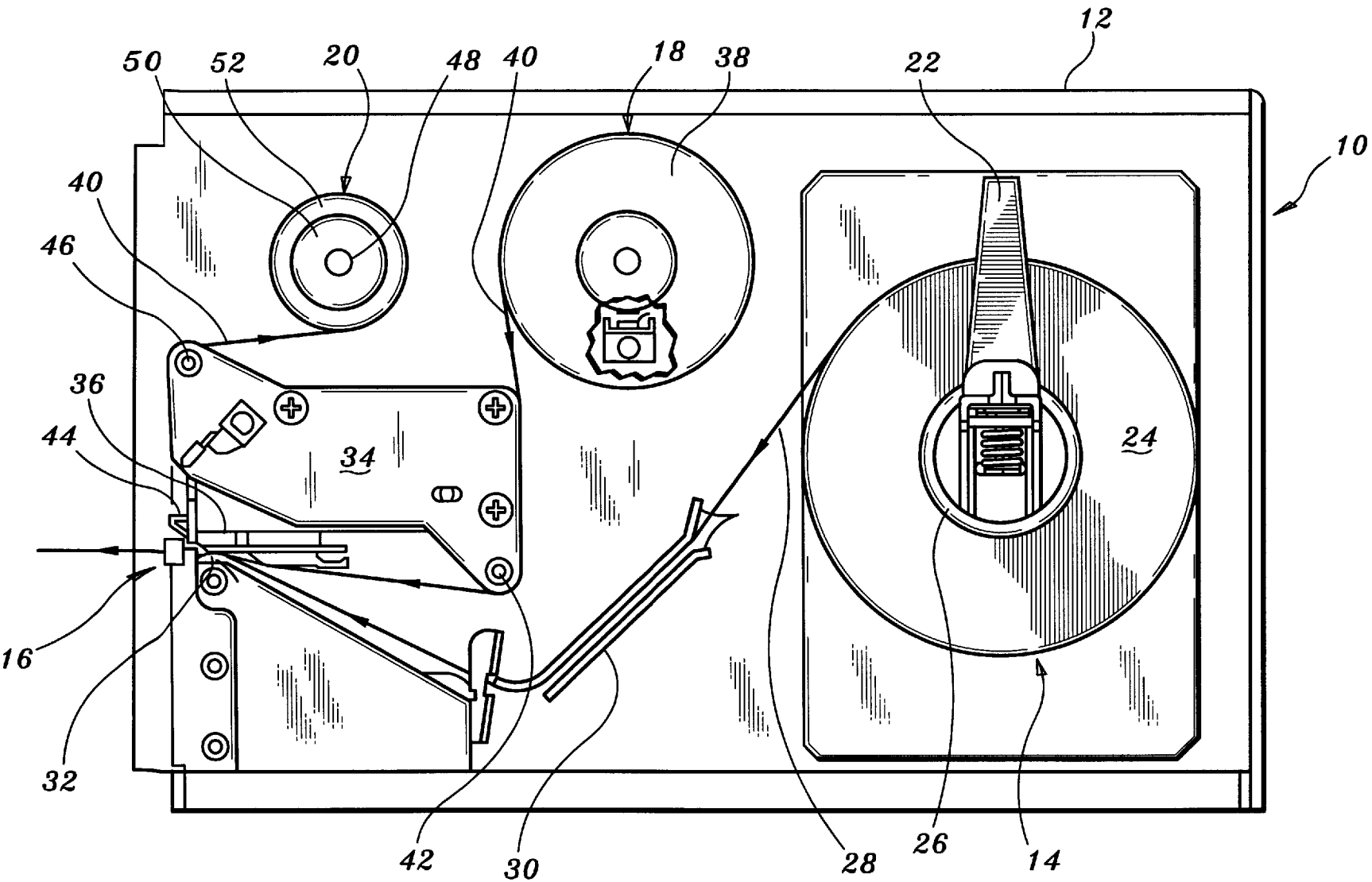
FIG. 1 is a schematic view of a printing section of a thermal label printer which may incorporate the ribbon supply hub of the present invention.

Referring now in detail wherein like reference numerals identify similar or like reference numerals throughout the several views, FIG. 1 illustrates, in schematic view, a representative printing section of a thermal printer which may utilize the ink ribbon supply of the present invention. This printing section is similar to the printing section disclosed in commonly assigned U.S. Pat. No. 5,326,182, the contents of which are incorporated herein by reference. Printing section 10 generally includes frame 12, media supply section 14, printing head section 16, ink ribbon supply section 18 and ink ribbon take-up section 20. Media supply section 14 includes support arm 22 which supports media supply roll 24. Media supply roll 24 includes core 26 of sleeve-like configuration and media web 28, consisting of blank labels provided on a coated paper substrate, wound into a roll about the core 26. Media web 28 is directed to printing head section 16 through guide 30 by rotation of pinch roller 32. The rotation of pinch roller 32 is under the direction of a motor of a control system (not shown).

Printing head section 16 includes support structure 34 and thermal head section 36 mounted to the support structure 34. Thermal head section 36 transfers ink to media web 28 to provide the desired print pattern.

Ink ribbon supply section 18 includes ribbon supply assembly 38 and a supply of ink ribbon 40 would into a coiled configuration about a ribbon core. Ribbon supply assembly 38 will be discussed in greater detail hereinbelow in connection with FIGS. 2–4. Ink ribbon 40 is directed about roller 42 mounted to support structure 34 and through printing thermal head section 36. Ink ribbon 40, after emerging from between pinch roller 32 and thermal head section 36, passes over plate 44 and roller 46, both of which are mounted in support structure 34, to ink take-up section 20.

Ink take-up section 20 includes drive shaft 48, drive support hub 50 and ink take-up roll 52 which accumulates the used ink ribbon 40 in a rolled configuration. Drive shaft 48 and drive support hub 50 are typically driven by an electric motor to advance the ink ribbon 40 from ink ribbon supply 38.

The above-described printing section 10 is representative of only one type of printing section for a thermal ink printer which may incorporate the ribbon supply assembly 38 of the present invention. It is to be appreciated that other printing arrangements may be adapted to utilize the ribbon supply assembly 38 as well.

Figure 2:
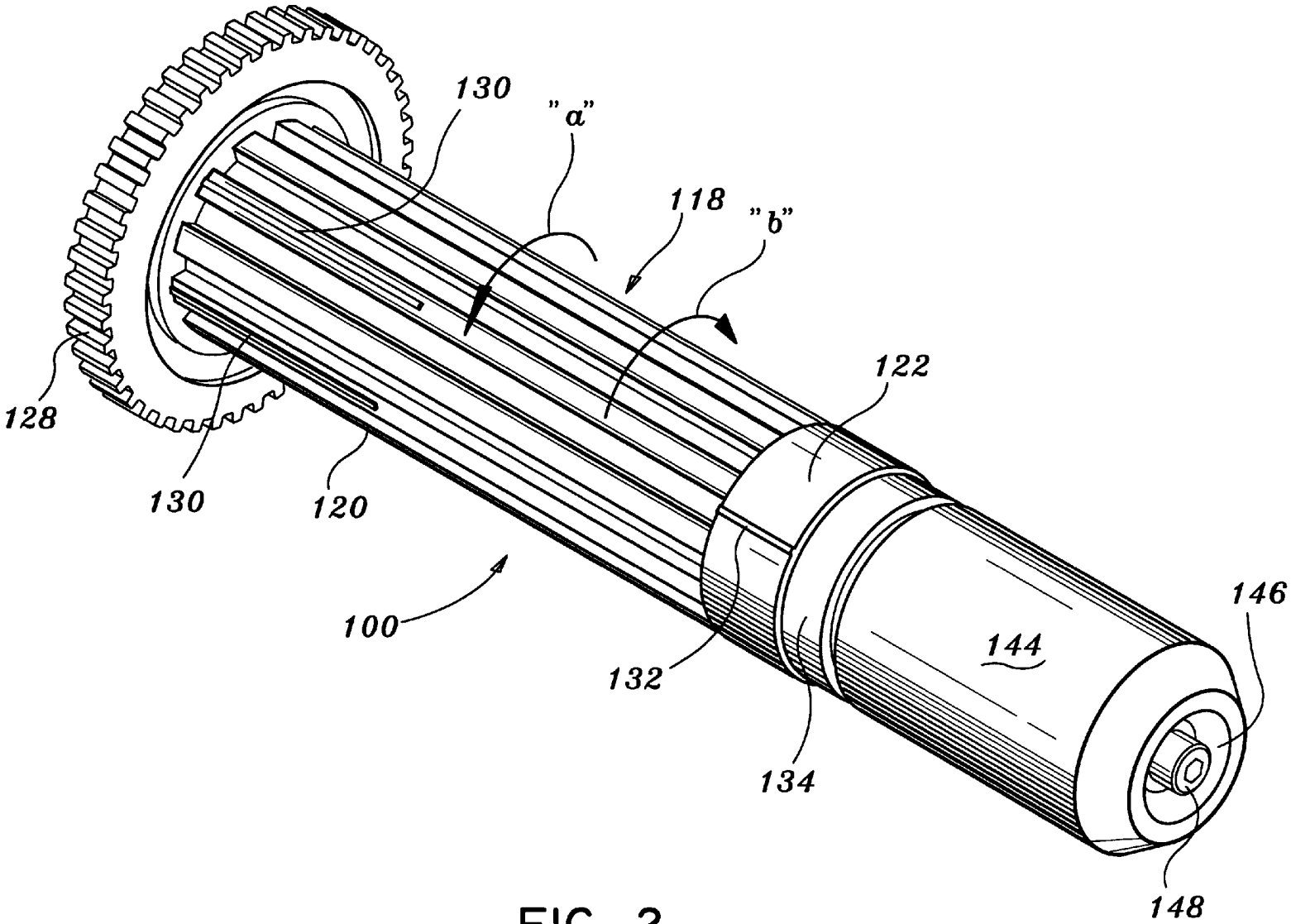
FIG. 2 is a perspective view of the ribbon supply hub.
Figure 3:
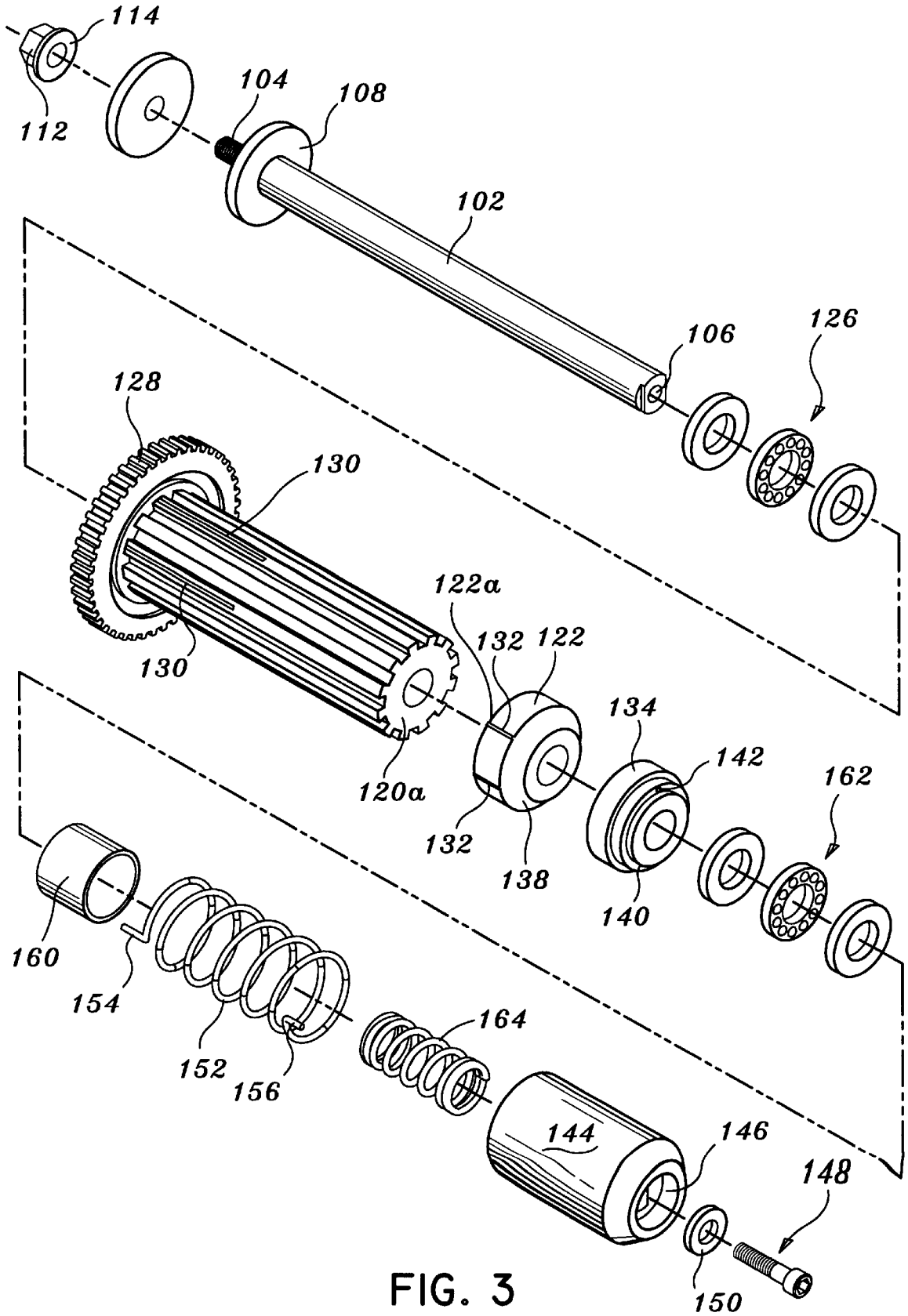
FIG. 3 is a perspective view with parts separated of the ribbon supply hub further detailing the components thereof.
Figure 4:
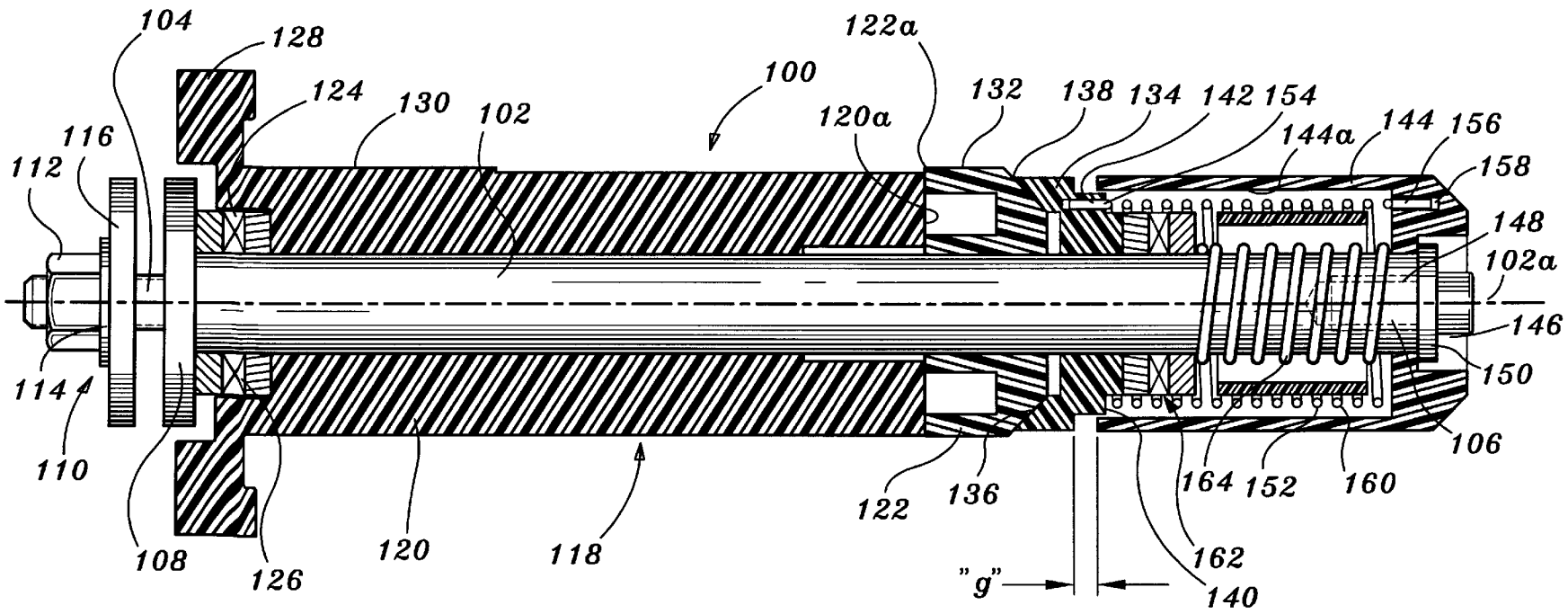
FIG. 4 is a side cross-sectional view of the ribbon supply hub.

Referring now to FIGS. 2–4, the ribbon supply assembly 38 in accordance with the principles of the present invention will be discussed in detail. Ribbon supply assembly 38 includes ribbon supply support or hub 100 which supports the coiled ink ribbon supply 40. Assembly 38 has central shaft 102 defining longitudinal axis 102*a* (FIG. 4). Central shaft 102 possesses external threaded portion 104 at its proximal end and internal threaded bore 106 at its distal end. A support flange 108 is mounted on shaft threaded portion 104 and is longitudinally fixed to the shaft threaded portion 104 by conventional means. Preferably, support flange 108 has an internal threaded bore which threadably engages shaft threaded portion 104. A locking nut assembly 110 is also mounted on shaft threaded portion 104. Locking nut assembly 110 consists of nut 112, washer 114 and locking flange 116. Locking nut assembly 110 is movable on shaft threaded portion 104 toward support flange 108 to fixedly mount assembly 100 to a portion of frame 12 (FIG. 1) which is positioned between support flange 108 and locking flange 116 of the locking nut assembly 110.

Ribbon supply assembly 100 further includes ribbon hub 118 coaxially mounted on central shaft 102. Ribbon hub 118 is mounted for rotational movement about central shaft 102 and consists of inner hub portion 120 and outer hub portion 122. Inner hub portion 120 includes inner recess 124 (FIG. 4) which receives thrust ball bearing assembly 126. Thrust ball bearing assembly 126 facilitates rotation of ribbon hub 118 by accommodating axial thrust forces exerted on ribbon hub 118 during operation. Inner hub portion 120 further includes toothed wheel 128. Toothed wheel 128 is used to engage a pinion gear. The pinion gear is attached to a controllable brake. When installed this can be used to stop the ribbon hub 118 from rotating to advance ink ribbon 40.

Referring still to FIGS. 2–4, inner hub portion 120 and outer hub portion 122 are two separate components as shown. In the assembled condition, adjacent respective surfaces 120*a*, 122*a* of inner hub portion 120 and outer hub portion 122 are in frictional engagement such that the two portions 120, 122 rotate together through at least a predetermined angular sector(s) of rotation. This feature will be discussed in greater detail below. Inner hub portion 120 and outer hub portion 122 further include respective longitudinal ribs 130, 132 extending along their outer surfaces. Longitudinal ribs 130, 132 are advantageously dimensioned to frictionally engage the interior surface of the ribbon core of the spool of ink ribbon 40 (FIG. 1) mounted thereabout whereby rotation of ribbon hub 118 causes corresponding rotation of the spool.

Ribbon supply assembly 100 further includes friction washer 134 mounted about central shaft 102 adjacent outer hub portion 122. Friction washer 134 defines an inner inclined surface 136 (FIG. 4) which contactingly engages a corresponding outer inclined surface 138 of outer hub portion 122 in frictional relation therewith such that the outer hub portion 122 and friction washer 134 rotate together at least through a predetermined angular sector of rotation in either rotational direction. Friction washer 134 further defines a vertical abutment surface 140 and longitudinal bore 142 extending adjacent the abutment surface 140.

Referring still to FIGS. 2–4, a spring housing 144 is mounted about the distal end portion of central shaft 102. Spring housing 144 includes distal recessed portion 146 which accommodates locking screw 148 and washer 150. Locking screw 148 threadably engages internal threaded bore 106 of central shaft 102 to fix (e.g. rotatably) spring housing 144 to central shaft 102. Spring housing 144 also defines an inner annular surface 144*a*.

With particular reference to FIGS. 3–4, spring housing 144 has coiled or torsion spring 152 disposed therein in co-axial arrangement about central shaft 102. The proximal end of torsion spring 152 terminates in proximal longitudinal mounting section 154 which is received in longitudinal bore 142 of friction washer 134. The distal end of torsion spring 152 terminates in distal longitudinal mounting section 156 which is received in inner longitudinal bore 158 disposed adjacent the distal end of spring housing 144. Torsion spring 152 is dimensioned to rotatably bias ribbon hub 118 to an initial rest position upon movement of ribbon hub in either rotational direction about longitudinal axis 102*a*. In the preferred embodiment, torsion spring 152 has a spring constant ranging from about 6 to 18 oz-in/rev.

Spring housing 144 further includes support collar 160 coaxially mounted about central shaft 102 with the outer surface of support collar 160 proximal torsion spring 152. Support collar 160 serves to support torsion spring 152 when the torsion spring 152 is under tension as effectuated through rotation of ribbon supply hub 118 in a first rotational direction and also to support the torsion spring 152 when the ribbon supply hub is rotated in a second rotational direction. The function of support collar 160 will be discussed in greater detail below. A thrust bearing assembly 162 similar to the thrust bearing assembly described above is disposed between support collar 160 and friction washer 134. Thrust bearing assembly 162 accommodates axial thrust loads exerted on spring housing 144 to facilitate rotation of friction washer 134 during the feeding operation.

A compression spring 164 is mounted about central shaft 102 within support collar 160. Compression spring 164 normally biases thrust bearing assembly 162, friction washer 134 and outer hub portion 122 toward inner hub portion 120. Compression spring 164 is dimensioned to maintain a sufficient level of force on friction washer 134 and outer hub portion 122 to establish a first frictional relationship between the adjacent surfaces 120*a*, 122*a*, of inner hub and outer hub portions 120, 122 and a second frictional relationship between respective inclined surfaces 136, 138 of friction washer 134 and the outer hub portion 122. The first and second frictional relationships as provided by the respective surfaces of the components provide first and second slip clutches having two distinct frictional torque levels. The torque level of the second frictional relationship (i.e., the second slip clutch) is greater than that of the first frictional relationship (i.e. first slip clutch). This is due, at least in part, to the inclined orientation of inclined surfaces 136, 138 of friction washer 134 and outer hub portion 122, which provide a greater surface area of contact between the components.

As stated above, the first and second slip clutches provide two distinct torque levels. It is envisioned that the first slip clutch comes into effect during use of the apparatus in conjunction with a ink ribbon supply spool having a relatively short axial length, i.e., a supply spool which when mounted on ribbon supply hub 118 extends only along inner hub portion 120 and not onto outer hub portion 122. When utilized with this length supply spool, the first clutch is adapted to permit inner hub portion 120 and outer hub portion 122 to rotate concurrently until the torsional force created by rotation of torsion spring 152 overcomes the frictional force between adjacent surfaces 120*a*, 122*b* of inner and outer hub portions 120, 122. Once this occurs, outer hub portion 122 "slips" relative to inner hub portion 120 (i.e., the first slip clutch releases) to permit the outer hub portion 122 and friction washer 134 to rotate under the influence of torsion spring 152 to a position corresponding to an unstressed condition of the torsion spring 152.

The second clutch is operative during use of the apparatus with an ink ribbon supply spool having a relatively large axial length, i.e., a supply spool which when mounted on ribbon supply hub 118 extends along both inner hub portion 120 and outer hub portion 122. When used in this manner, inner hub portion 120, outer hub portion 122 and friction washer 134 rotate concurrently until the torsional force created by rotation of torsion spring 152 overcomes the frictional force between inclined surfaces 136, 138 of friction washer 134 and outer hub portion 122. Once this occurs, friction washer 134 "slips" relative to outer hub portion 122 (i.e., the second slip clutch releases) to permit the friction washer 134 to rotate under the influence of torsion spring 152 to the unstressed condition of the torsion spring 152. Thus, the first and second clutches provide flexibility with respect to choice of torque levels on ribbon hub 118 during the ribbon feeding process.

Referring still to FIGS. 3–4, spring housing 144 and central shaft 102 are reciprocally longitudinally movable relative to ribbon hub 118 and friction washer 134 for a limited distance as provided by gap "g" defined between spring housing 144 and friction washer 134. This movement prevents excessive deflection of compression spring 164.

Further details of the ink ribbon supply assembly 38 of the present invention will be better appreciated by the following description of same in use to feed ink ribbon 40 to the printing head section 16 of the printing section disclosed in FIG. 1. The description will initially be directed to use of the assembly 100 with a supply spool of ink ribbon having a short axial length (i.e., a supply which when mounted on ribbon hub 118 only extends along inner hub portion 120).

The ribbon supply assembly 100 of the present invention may be utilized to feed ink ribbon 40 in either rotational direction of ribbon hub 118. In particular, ribbon hub 118 may rotate in the direction indicated by directional arrow "a" (FIG. 2) to feed the ink ribbon to printing head section 16, or the ribbon hub 118 may rotate in the direction indicated by the directional arrow "b" to feed the ink ribbon (FIG. 2). The particular rotation or use of the ribbon hub 118 will depend on the manner in which the ink ribbon 40 and labels are coiled on the supply spool. In use of supply assembly 100 in the rotational direction "a" of ribbon hub 118, the spool of wound ink ribbon 40 is positioned on the ribbon hub 118 (i.e., about inner hub portion 120) and the motor associated with "take up" section 20 is actuated to pull the ink ribbon with labels off the ribbon hub 118. As indicated above, inner hub portion 120 is provided with longitudinal ribs 130 to frictionally engage the inner surface of the ribbon spool such that rotation of the spool causes corresponding rotation of the inner hub portion 120. As inner hub portion 120 rotates in the direction of directional arrow "a", outer hub portion 122 and friction washer 134 also rotate in the same direction. Such rotation causes torsion spring 152 to be tensioned, i.e., the rotation of friction washer 134 causes the proximal end 154 of torsion spring 152 to rotate about the central axis 102 while the distal spring end 156 remains stationary, thereby tensioning the torsion spring 152. As appreciated, the torsion spring 152 continually rotatably biases ribbon hub 118 in the direction of arrow "b" corresponding to an unstressed condition of the torsion spring 152, thus maintaining a sufficient level of tension on the ink ribbon during feeding and the printing step.

Upon continued rotation of ribbon hub 118 in direction "a", the cross-sectional dimension of torsion spring 152 reduces along at least a portion of its length. Upon movement of the ribbon hub 118 through a first predetermined angular sector of rotation, torsion spring 152 is reduced in cross-section to engage support collar 160 whereby the support collar 160 prevents any further tensioning motion on the spring portion supported thereby. Once the torsional force or torque of torsion spring 152 overcomes the frictional forces between surfaces 120*a,* 122*a* (as provided by compression spring 164) of inner and outer hub portions 120, 122, the first slip clutch releases thereby permitting outer hub portion 122 along with friction washer 134 to slip or move relative to the inner hub portion 120 (in the direction "b") under the influence of torsion spring 152 to cause the torsion spring 152 to move to its initial unstressed condition. As stated above, the first slip clutch has a torque level which is less than the torque level of the second slip clutch. Accordingly, the first slip clutch will release thereby preventing release of the second clutch. At this point, torsion spring 152 is reset and ribbon hub 118 may be rotated in a similar manner (in direction "a") to feed ink ribbon 40 to printing head section 16.

Ribbon hub 118 may also operate to feed ink ribbon by rotating in the feed direction of directional arrow "b". During movement of ribbon hub 118 in this direction, torsion spring 152 is caused to move in a direction corresponding to a stressed condition whereby the torsion spring 152 expands in cross-sectional dimension along at least a portion of its length, i.e., proximal end section 154 of spring 152 moves with friction washer 134 while distal end section 156 of spring 152 remains stationary to cause the spring 152 to "unwind". It is to be appreciated that during such movement of spring 152, the spring may have a tendency to deform or radially displace. Such undesired movement, however, is prevented by support collar 160 which engages the spring 152 to maintain the axial arrangement of the spring 152. The torsional characteristics of torsion spring 152 (i.e., the tendency of torsion spring 152 to return to its initial unstressed condition) continuously biases rotation hub 118 in direction "a" thereby maintaining a level of tension on the ink ribbon supply during feeding and printing. Ribbon hub 118 is rotated in direction "b" through a predetermined angular sector of rotation corresponding to a position where the torsion spring 152 expands in cross-section along at least a portion of its length to engage the inner annular surface 144*a* of spring housing 144. At this position, inner surface 144*a* of spring housing 144 prevents any further movement of torsion spring 152 in this direction. When the torsional force of torsion spring 152 overcomes the forces (friction) between surfaces 120*a,* 122*a* of inner and outer hub portions 120, 122, the first slip clutch releases thereby permitting outer hub portion 122 and friction washer 134 to rotate in direction "a" to permit torsion spring 152 to assume its initial at-rest position. Thus, torsion spring 152 is reset to permit continued feeding in direction "b".

Thus, the ribbon supply assembly of the present invention maintains a sufficient level of tension on the ribbon web regardless of the rotational direction of ribbon hub 118. In the first rotational direction, support collar 160 supports torsion spring 152 to prevent "over-tensioning" of the torsion spring. In the second rotational direction, spring housing 144 prevents undesired unwinding of torsion spring 152 while support collar maintains the general axial alignment of the spring 152. Thus, in either direction, distortion of torsion spring 152 is minimized.

Ribbon supply assembly 100 operates in a similar manner when used with an ink ribbon supply spool having a relatively large axial length (i.e., when positioned on ribbon supply hub 118, the spool extends along inner hub portion 120 and outer hub portion 122) except that the second slip clutch releases when ribbon hub 118 is rotated (in either direction A or B) beyond the desired predetermined angular sector of rotation(s) to permit torsion spring 152 to return to its initial unstressed condition. Inner hub portion 120 and outer hub portion 122 rotate with the spool due to engagement of respective longitudinal ribs 130, 132 with the spool inner surface. Support collar 160 and spring housing 144 minimize deformation of torsion spring 152 in a similar manner.

While the above description contains many specifics, these specifics should not be construed as limitations on the scope of the disclosure, but merely as exemplifications of preferred embodiments thereof. For example, it is envisioned that ribbon supply assembly may incorporate only one slip clutch arrangement. In addition, other types of slip clutch arrangements are envisioned as well including powered or driven shafts through the same arrangement. Those skilled in the art will envision many other possible variations that are within the scope and spirit of the disclosure as defined by the claims appended hereto.

What is claimed is:

1. An ink supply spool for a thermal ink printer, which comprises:

a central shaft defining a longitudinal axis;

a ribbon hub coaxially mounted about said central shaft and adapted for rotational movement thereabout, said ribbon hub adapted to support a supply of ink transfer ribbon in a coiled configuration;

a torsion spring mounted about said central shaft and operatively engageable with said ribbon hub to rotatably bias said ribbon hub to an initial position corresponding to an unstressed condition of said torsion spring in response to movement of said ribbon hub through a predetermined angular sector of rotation in one rotational direction, to thereby maintain a predetermined level of tension on the ink transfer ribbon;

clutch means associated with said ribbon hub to permit said torsion spring to return to said unstressed condition in response to movement of said ribbon hub beyond said predetermined angular sector of rotation; and a separate support collar mounted about said central shaft and being disposed within said torsion spring, said support collar extending along a substantial portion of the length of said torsion spring and being dimensioned and configured for supporting said torsion spring during movement of said ribbon hub in said one rotational direction.

2. The ink supply spool according to claim 1 wherein said support collar and said torsion spring are coaxially mounted about said central shaft.

3. The ink supply spool according to claim 2 wherein said support collar is dimensioned to be engaged by said torsion spring in supporting contacting relation therewith upon movement of said ribbon hub through said predetermined angular sector of rotation.

4. The ink supply spool according to claim 3 wherein said clutch means comprises an outer member mounted about said central shaft adjacent said ribbon hub, said outer member in operative engagement with said torsion spring and in frictional engagement with said ribbon hub along respective adjacent surfaces of said ribbon hub and said outer member, said outer member movable with said ribbon hub in said one direction whereby movement of said ribbon hub beyond said predetermined angular sector of rotation causes release of said adjacent surfaces of said outer member and said ribbon hub due to torsional forces of said torsion spring, to permit said spring to return to an unstressed condition thereof.

5. The ink supply spool according to claim 4 wherein said clutch means comprises a compression spring operatively engageable with said outer member and dimensioned to bias said outer member toward said ribbon hub.

6. The ink supply spool according to claim 3 including a spring housing mounted to said central shaft and dimensioned to at least partially enclose said torsion spring.

7. The ink supply spool according to claim 6 wherein said torsion spring is adapted to rotatably bias said ribbon hub to said initial position upon movement of said ribbon hub through a second predetermined angular sector of rotation in a second rotational direction.

8. The ink supply spool according to claim 7 wherein said spring housing includes an inner surface dimensioned to be engaged by said torsion spring in supporting contacting relation therewith upon movement of said ribbon hub through said second predetermined angular sector of rotation.

9. An ink supply spool for a thermal ink printer, which comprises:

a central shaft defining a longitudinal axis;

a ribbon hub coaxially mounted about said central shaft and adapted for rotational movement thereabout, said ribbon hub adapted to support a supply of ink transfer ribbon in a coiled configuration;

a torsion spring mounted about said central shaft and operatively engageable with said ribbon hub to rotatably bias said ribbon hub to an initial position corresponding to an unstressed condition of said torsion spring in response to movement of said ribbon hub through a predetermined angular sector of rotation in one rotational direction, to thereby maintain a predetermined level of tension on the ink transfer ribbon;

first and second clutch arrangements associated with said ribbon hub to permit said torsion spring to return to said unstressed condition in response to movement of said ribbon hub beyond said predetermined angular sector of rotation, said first and second clutch arrangements having first and second torque levels, said second torque level being greater than said first torque level; and a support collar mounted about said central shaft adjacent said torsion spring for supporting said torsion spring during movement of said ribbon hub in said one rotational direction.

10. The ink supply spool according to claim 9 wherein said first clutch arrangement comprises an outer hub mounted about said central shaft adjacent said ribbon hub, said outer hub in operative engagement with said torsion spring and in frictional engagement with said ribbon hub along respective adjacent surfaces of said ribbon hub and said outer hub, said outer hub movable with said ribbon hub in said one direction whereby movement of said ribbon hub beyond said predetermined angular sector of rotation causes release of said adjacent surfaces of said outer hub and said ribbon hub due to torsional forces of said torsion spring, to permit said spring to return to an unstressed condition thereof.

11. The ink supply spool according to claim 10 wherein said second clutch arrangement comprises a friction washer mounted about said central shaft adjacent said outer hub, said friction washer in operative engagement with said torsion spring and in frictional engagement with said outer hub along respective adjacent surfaces of said outer hub and said friction washer, said friction washer movable with said outer hub in said one direction whereby movement of said ribbon hub beyond said predetermined angular sector of rotation causes release of said adjacent surfaces of said friction washer and said ribbon hub due to torsional forces of said torsion spring, to permit said spring to return to an unstressed condition thereof.

12. An ink supply spool for a thermal ink printer, which comprises:

a central shaft defining a longitudinal axis;

a ribbon hub coaxially mounted about said central shaft and adapted for rotational movement in first and second rotational directions, said ribbon hub adapted to support a supply on ink transfer ribbon in a coiled configuration, said ribbon hub including an inner member and an outer member, said inner member and said outer member in frictional contacting engagement along adjacent surfaces thereof such that said inner member and said outer member concurrently rotate in said first and second rotational directions;

a coil spring mounted about said central shaft and operatively connected to said outer member and to said central shaft to rotatably bias said ribbon hub to an initial unstressed condition thereof in response to movement of said ribbon hub through respective first and second predetermined angular sectors of rotation in said first and second rotational directions, to thereby maintain a predetermined level of tension of the ink transfer ribbon, said coil spring dimensioned and configured to cause release of said adjacent surfaces of said inner and outer members from their frictional contacting engagement in response to movement of said ribbon hub beyond either said first and second predetermined angular sectors of rotation, to thereby permit said coil spring to return to an initial unstressed condition;

a support collar coaxially mounted within said coil spring, said support collar dimensioned to be engaged by said coil spring during rotation of said ribbon hub in at least said first rotational direction to support said coil spring to minimize deformation thereof; and a spring housing coaxially mounted about said coil spring, said spring housing having an inner annular surface, said inner surface dimensioned to engage said coil spring during rotation of said ribbon hub in said second rotational direction to support said coil spring and minimize deformation thereof.

13. The ink supply spool according to claim 12 wherein said support collar is dimensioned to be engaged by said coil spring during rotation of said ribbon hub in said second rotational direction to support said coil spring.

14. The ink supply spool according to claim 12 further including a compression spring for biasing said outer member toward said inner member to cause the frictional contacting engagement of said adjacent surfaces thereof.

15. An ink supply spool for a thermal ink printer, which comprises:

a central shaft defining a longitudinal axis;

a ribbon hub coaxially mounted about said central shaft and adapted for rotational movement thereabout, said ribbon hub adapted to support a supply of ink transfer ribbon in a coiled configuration;

a torsion spring mounted about said central shaft and operatively engageable with said ribbon hub to rotatably bias said ribbon hub to an initial position corresponding to an unstressed condition of said torsion spring, to thereby maintain a predetermined level of tension on the ink transfer ribbon;

first clutch means associated with said ribbon hub to permit said torsion spring to return to said unstressed condition in response to movement of said ribbon hub beyond a first predetermined angular sector of rotation in at least one rotational direction;

second clutch means associated with said ribbon hub to permit said torsion spring to return to said unstressed condition in response to movement of said ribbon hub beyond a second predetermined angular sector of rotation in said one rotational direction; and a support collar mounted about said central shaft adjacent said torsion spring for supporting said torsion spring during movement of said ribbon hub.

16. The ink supply spool according to claim 15 wherein said ribbon hub is adapted to rotate in first and second rotational directions.

17. The ink supply spool according to claim 16 wherein said first clutch means is adapted to permit said torsion spring to return to said unstressed condition in response to movement of said ribbon hub beyond said first predetermined angular sector of rotation in each of said first and second rotational directions.

18. The ink supply spool according to claim 17 wherein said second clutch means is adapted to permit said torsion spring to return to said unstressed condition in response to movement of said ribbon hub beyond said second predetermined angular sector of rotation in each of said first and second rotational directions.

19. The ink supply spool according to claim 18 wherein said first clutch means includes an outer hub mounted adjacent said ribbon hub, said ribbon hub and said outer hub in frictional contacting engagement along adjacent surfaces thereof such that said ribbon hub and said outer hub concurrently rotate until said ribbon hub rotates beyond said first predetermined angular sector of rotation whereby said first clutch means releases thereby permitting said outer hub to move relative to said inner hub to cause said tension spring to move to said unstressed condition thereof.

20. The ink supply spool according to claim 19 wherein said second clutch means includes a friction washer mounted adjacent said outer hub, said outer hub and said friction washer in frictional contacting engagement along adjacent surfaces thereof such that said outer hub and said friction washer concurrently rotate until said ribbon hub rotates beyond said second predetermined angular sector of rotation whereby said second clutch means releases thereby permitting said friction washer to move relative to said outer hub and said ribbon hub to cause said tension spring to move to said unstressed condition thereof.

21. An ink supply spool for a thermal ink printer, which comprises:

a central shaft defining a longitudinal axis;

a ribbon hub coaxially mounted about said central shaft and being adapted for rotational movement, said ribbon hub dimensioned to support a supply of ink transfer ribbon in a coiled configuration;

a torsion spring mounted about said central shaft in coaxial relation with said central axis and being dimensioned to rotatably bias said ribbon hub to an initial position corresponding to an unstressed condition of said torsion spring upon rotational movement of said ribbon hub in one rotational direction, to thereby maintain a predetermined level of tension on the ink transfer ribbon; and a spring support mounted about said central shaft, said spring support at least partially disposed within said torsion spring and extending at least along a major portion of the length of said torsion spring, said spring support dimensioned to supportingly engage said torsion spring upon rotation of said torsion spring through a predetermined angular sector of rotation to thereby support said torsion spring to minimize deformation thereof.

22. The ink supply spool according to claim 21 wherein said spring support includes at least one support member.

23. The ink supply spool according to claim 22 wherein said at least one support member includes a support collar mounted within said torsion spring in coaxial relation with said central axis.

24. The ink supply spool according to claim 23 includes a plurality of support members mounted about said central shaft in coaxial relation with said central axis.

25. The ink supply spool according to claim 23 further including an outer friction member mounted about said central shaft adjacent said ribbon hub and operatively connected to said torsion spring, said outer friction member in frictional contacting engagement with said ribbon hub whereby said ribbon hub and said outer friction member concurrently rotate in said one rotational direction until forces developed in said torsion spring exceed the frictional force between said outer friction member and said ribbon hub.

26. The ink supply spool according to claim 25 including a biasing member in operative engagement with said outer friction member to cause the frictional contacting engagement of the outer friction member with the ribbon hub.

* * * * *